US009289892B2

(12) United States Patent
Schreiber

(10) Patent No.: US 9,289,892 B2
(45) Date of Patent: Mar. 22, 2016

(54) HAND-HELD POWER TOOL

(75) Inventor: Alfred Schreiber, Kirchheim (DE)

(73) Assignee: C. & E. FEIN GMBH (DE)

( * ) Notice: Subject to any disclaimer, the term of this patent is extended or adjusted under 35 U.S.C. 154(b) by 661 days.

(21) Appl. No.: 13/524,235

(22) Filed: Jun. 15, 2012

(65) Prior Publication Data

US 2012/0318545 A1 Dec. 20, 2012

(30) Foreign Application Priority Data

Jun. 16, 2011 (DE) ..... 10 2011 104 901

(51) Int. Cl.
*B25F 5/00* (2006.01)
*B25F 3/00* (2006.01)

(52) U.S. Cl.
CPC .... *B25F 3/00* (2013.01); *B25F 5/00* (2013.01)

(58) Field of Classification Search
CPC ..... B23Q 15/00; B25F 5/00
USPC ..... 173/1, 2, 4, 217, 162.1
See application file for complete search history.

(56) References Cited

U.S. PATENT DOCUMENTS

| | | | | |
|---|---|---|---|---|
| 5,874,681 | A * | 2/1999 | Habele | 73/862.325 |
| 6,320,286 | B1 * | 11/2001 | Ramarathnam | 310/50 |
| 6,845,279 | B1 * | 1/2005 | Gilmore et al. | 700/115 |
| 7,197,373 | B2 | 3/2007 | Fiebig et al. | |
| 7,540,697 | B2 * | 6/2009 | Wang et al. | 409/141 |
| 7,551,411 | B2 * | 6/2009 | Woods et al. | 361/33 |
| 2001/0052416 | A1 * | 12/2001 | Wissmach et al. | 173/4 |
| 2003/0037423 | A1 * | 2/2003 | Siegel | 29/407.01 |
| 2003/0182016 | A1 * | 9/2003 | Fiebig et al. | 700/168 |
| 2006/0065415 | A1 * | 3/2006 | Berg | 173/2 |
| 2006/0289183 | A1 | 12/2006 | Schreiber | |
| 2008/0289923 | A1 | 11/2008 | Suzuki et al. | |
| 2009/0195204 | A1 * | 8/2009 | Gumpert | 318/460 |
| 2011/0024144 | A1 * | 2/2011 | Usselman et al. | 173/1 |
| 2011/0162858 | A1 * | 7/2011 | Coste | 173/1 |

FOREIGN PATENT DOCUMENTS

| | | | |
|---|---|---|---|
| DE | 10029133 | A1 | 1/2002 |
| DE | 10212064 | A1 | 10/2003 |
| DE | 102007010800 | A1 | 9/2008 |
| EP | 2085755 | A1 | 8/2009 |
| EP | 2279831 | A1 | 2/2011 |

* cited by examiner

*Primary Examiner* — Nathaniel Chukwurah
(74) *Attorney, Agent, or Firm* — St. Onge Steward Johnston & Reens, LLC

(57) ABSTRACT

A power-operated hand-held power tool, in particular a power tool comprising an oscillation drive for driving a tool in an oscillating manner, comprising at least one sensor for detecting vibrations and comprising a controller which is coupled to the at least one sensor to control at least one operating parameter of the power tool according to an output signal of the at least one sensor, the power tool being configured to receive different tools, and the controller being configured to evaluate the output signal of the at least one sensor and preferably to compare the output signal with stored characteristic values for the vibrations of different tools so as to control at least one operating parameter of the power tool according to said comparison, is specified.

18 Claims, 2 Drawing Sheets

HAND-HELD POWER TOOL

CROSS REFERENCES TO RELATED APPLICATIONS

This application claims priority from German patent application 10 2011 104 901.4, filed on Jun. 16, 2011. The entire contents of this priority application is incorporated herein by reference.

BACKGROUND OF THE INVENTION

The invention relates to a hand-held power tool, in particular a power tool comprising an oscillation drive for driving a tool in an oscillating manner, comprising at least one sensor for detecting vibrations and comprising a controller which is coupled to the at least one sensor to control at least one operating parameter of the hand-held power tool according to an output signal of the at least one sensor, the hand-held power tool being configured to receive different tools.

The invention further relates to a method for controlling a hand-held power tool, in which the vibrations are detected and controlled according to at least one operating parameter of the hand-held power tool.

A hand-held power tool of this type and a method of this type are known from EP 2 279 831 A1.

In that case, a hammer drill is concerned in which a sensor is provided for detecting vibrations and wherein the drive motor of the hammer drill is controlled according to the output signal of the sensor in such a way that a permissible value for the vibrations is not exceeded.

The arrangement concerned is configured specifically for a hammer drill, however.

A similar arrangement and a similar method for reducing vibrations are known from EP 2 085 755 A1. In this case, the speed of the motor is to be limited on the basis of vibration values detected by sensors.

Lastly, it is known from US 2008/0289923 A1, in the case of a power tool, to detect an undesired jerking of a core drill by means of vibration sensors and to establish therefrom an optimal drive speed at which the jerking is minimized.

In the known machines, it is not taken into account that different vibratory conditions are produced with use of different tools on a machine.

SUMMARY OF THE INVENTION

In view of this, it is a first object of the invention is to disclose a hand-held power tool allowing for optimized operating performance.

It is a first object of the invention is to disclose a hand-held power tool comprising an oscillatory drive allowing for optimized operating performance, while limiting vibrations.

It is a third object of the invention to disclose a hand-held power tool whereby optimized operating performance can be achieved, even with use of different tools on the hand-held power tool.

It is a fourth object of the invention to disclose a method of operating a hand-held power tool whereby optimized operating performance can be achieved, while limiting vibrations.

According to one aspect of the invention these and other objects are achieved by a hand-held power tool, comprising:

a controller for controlling said power tool;

at least one sensor for detecting vibrations of said power tool and for generating an output signal characteristic for said vibrations;

wherein said power tool is configured for operating with a plurality of different tools;

wherein said controller is coupled to said at least one sensor and is configured for evaluating said output signal to generate at least one control signal for controlling at least one operating parameter of said power tool depending on said evaluation of said output signal of said at least one sensor.

According to a further aspect of the invention there is disclosed a method comprising the steps of:

detecting at least one characteristic value for vibrations;

storing said at least one characteristic value for each one of a plurality of different tools with which the power tool can be operated;

comparing said stored characteristic value with a characteristic value for vibrations with a tool currently received on the power tool and generating a control signal thereby; and controlling at least one operating parameter of the power tool using said control signal.

In accordance with the invention, namely by evaluation of the output signal of the at least one sensor for detecting vibrations, at least one operating parameter is controlled in such a way that an adaptation is made according to the detected vibrations. The hand-held power tool can thus be operated with optimized operating performance.

In a preferred development of the invention, the controller is configured to evaluate the output signal of the at least one sensor and to compare it with stored characteristic values for the vibrations of the different tools so as to control at least one operating parameter of the hand-held power tool according to said comparison.

By comparing stored characteristic values for the vibrations of the different tools with the output signal of the at least one sensor for a tool currently received on the hand-held power tool, the at least one operating parameter can thus be controlled in such a way that an adaptation can be made according to the tool received on the machine. The operating performance can thus be optimized further.

In a preferred development of the invention, the controller is configured preferably to evaluate the output signal of the at least one sensor during start-up or in the idle state so as to limit the vibratory behaviour of the hand-held power tool to a permissible maximum value according to said evaluation.

As a result of this measure, it is ensured that a legally prescribed or physiologically expedient maximum value for the vibratory behaviour of the hand-held power tool is not exceeded.

According to a further embodiment of the invention, the controller is configured to record and store the output signal of the at least one sensor during a set-up mode, preferably during start-up or in the idling state, for the different tools.

The controller can be configured to evaluate the output signal of the at least one sensor, preferably during start-up or in the idle state, and to compare it with the values for different tools stored previously during the set-up mode so as to determine the type of tool.

A sensor for tool recognition can also be provided alternatively or in addition.

The tool may also comprise a device for transferring data to the hand-held power tool so that, for example, the tool can transfer its vibratory characteristics to the hand-held power tool. This device can be an RFID chip (transponder) on the tool for example, said chip cooperating with a sensor circuit on the hand-held power tool.

As a result of these measures, the hand-held power tool can be adapted specifically to the respective tool according to the type of tool recognized with the aid of the vibratory behaviour or with the aid of a sensor so as to ensure optimized operation.

According to a further embodiment of the invention, the controller comprises a memory, in which a map for the operating parameters of the different tools is stored.

According to a further embodiment of the invention, the controller is configured to optimize the operating parameters according to the recognized tool, possibly on the basis of a stored map.

For example, the vibratory behaviour of the hand-held power tool can thus be limited to a permissible maximum value and, at the same time, it can be ensured that the tool is operated in an optimal range so as to achieve the best possible working result.

According to a further embodiment of the invention, the controller is configured to limit speed or power consumption, as an operating parameter, in such a way that a maximum value for the acceleration of the hand-held power tool in at least one direction is not exceeded.

For example, the controller can be configured to limit acceleration preferably in all spatial directions to a maximum value of 5 $m/s^2$.

A permissible maximum value for acceleration and for the vibration associated therewith can thus be observed and is 5 $m/s^2$ for example.

According to a further embodiment of the invention, at least one sensor is provided and is selected from the group consisting of an acceleration sensor in one, two or three directions, a rotational acceleration sensor, an amperage sensor, a speed sensor, a voltage sensor and a phase sensor for the control angle in the event of phase control.

In particular, when the vibratory behaviour of the power tool is to be limited, an acceleration sensor for one, two or three spatial directions (1D, 2D, 3D) or a rotational acceleration sensor is preferably used. By contrast, an amperage sensor, a speed sensor, a voltage sensor or a phase sensor for the control angle in the event of phase control is preferably used for the operating parameters of the machine.

In the case of use of a set-up mode, in which the output signal of the at least one sensor is received and stored during a set-up mode, the set-up mode can be run at least during a first start-up of the hand-held power tool.

The set-up mode can be activated automatically by a specific condition, alternatively or in addition.

The set-up mode can thus be activated automatically, for example upon each new start of the controller or upon each new connection of the hand-held power tool to an external power supply.

Furthermore, an actuation member, for example a switch, can be provided to activate the set-up mode.

Since, in the set-up mode, a series of different tools have to be checked so as to determine the characteristic behaviour thereof, in particular vibratory behaviour, under different operating conditions, it is relatively time-consuming to run the set-up mode.

According to a further embodiment of the invention, the characteristic data detected with a sample machine when the set-up mode is run with different tools therefore can be read into a memory of the control unit.

The performance, known in principle, of the hand-held power tool with the different tools therefore can be evaluated once and thus stored in a memory of the hand-held power tool and used to optimize the vibratory behaviour of the hand-held power tool for example, and/or to optimize the operating parameters of the hand-held power tool, and/or to limit the vibratory behaviour of the hand-held power tool to a permissible maximum value.

The hand-held power tool can be set in such a way that the vibrations of the hand-held power tool are limited in principle to a permissible maximum value.

Starting from this basis, however, it may also be possible to temporarily deactivate this automatic limitation of the hand-held power tool to a permissible maximum value, for example so as to undertake particularly demanding machining processes without limiting speed for example or another variable.

A specific task can thus be carried out which, if work is carried out quickly, then leads to a high vibratory load which is applied to the user, but no further due to the short period of effect. Such an "overrule mode" can preferably be activated by a specific switch.

Alternatively or in addition, a temporally defined deactivation may be implemented, or the normal mode can be reset again after each new start by defining the operating parameters of the hand-held power tool so as to ensure, for example, that the vibratory behaviour is limited to a maximum value.

It is understood that the features described above and those yet to be explained below can be used not only in the combinations specified in each case, but also in other combinations or alone, without departing from the scope of the present invention.

Further features and advantages of the invention will emerge from the following description of preferred exemplary embodiments given with reference to the drawing, in which:

DESCRIPTION OF PREFERRED EMBODIMENTS

Figure 1:
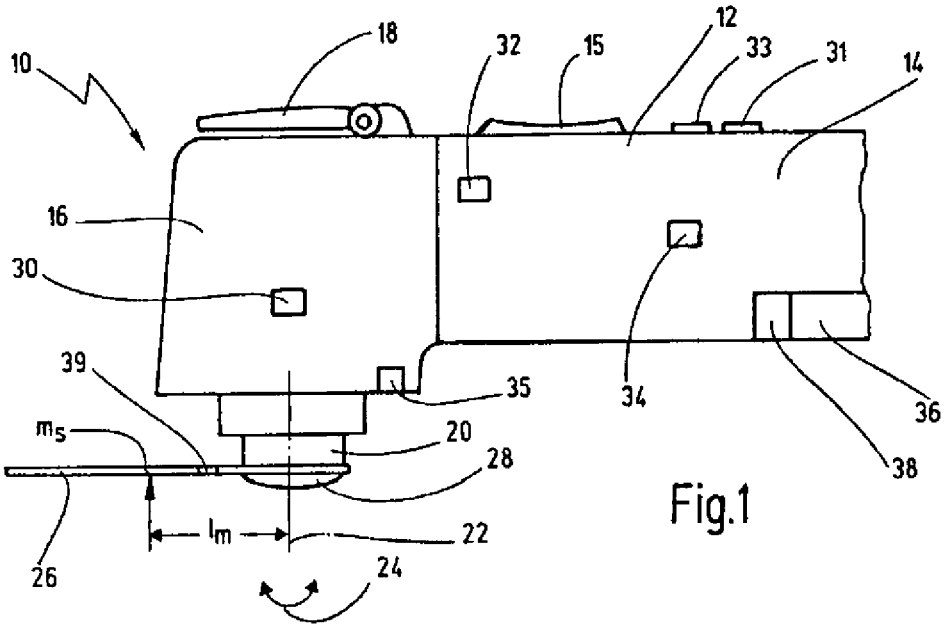
FIG. 1 shows a simplified partial view of a hand-held power tool according to the invention in the region of the drive motor and of an oscillation drive and with a tool received in the drive spindle.

FIG. 1 illustrates a hand-held power tool according to the invention in the region of the front end thereof and is denoted as a whole by numeral 10. The hand-held power tool 10 comprises a housing 12, in which a motor 14 is received which drives an oscillation transmission 16. The oscillation transmission 16 drives a tool spindle 20 which is driven in an oscillatory manner about its longitudinal axis 22, as indicated by an arrow 24. The longitudinal axis 22 thus simultaneously forms an oscillation axis. A tool 26 is received on the tool spindle 20 and is fastened with the aid of a securing element 28.

So as to enable the tool 26 to be changed without the aid of an additional tool, a clamping lever 18 is provided on the upper side of the housing 12 and can be pivoted so that, in a release position, the securing element 28 can be removed so as to change the tool 26. By contrast, the tool 26 is fixed securely to the tool spindle 20 in the clamping position of the clamping lever 18, shown in FIG. 1.

The rotational movement of the motor 14 is converted by the oscillation transmission 16 into a rotational oscillatory movement about the longitudinal axis 22 at a high frequency of approximately 5,000 to 20,000 oscillations per minute and with a pivot angle between approximately 0.5° and 5°.

Vibrations are caused by this oscillatory movement and can be aggravating or even physiologically disadvantageous for the user. There is therefore a legal provision in the EU that the acceleration must be limited to a maximum value of 5 $m/s^2$ (based on an 8-hour working day).

The vibrations produced and the acceleration values are naturally dependent on the tool 26 and load which are used during operation. Different acceleration values are provided depending on the tool 26 used.

This is illustrated by way of example in FIG. 1 by an arrow which is directed to the centre of mass $m_s$ of the tool 26. The greater the distance $I_m$ of the centre of mass $m_s$ from the oscillation axis 22, the greater the acceleration values which occur.

Figure 3:
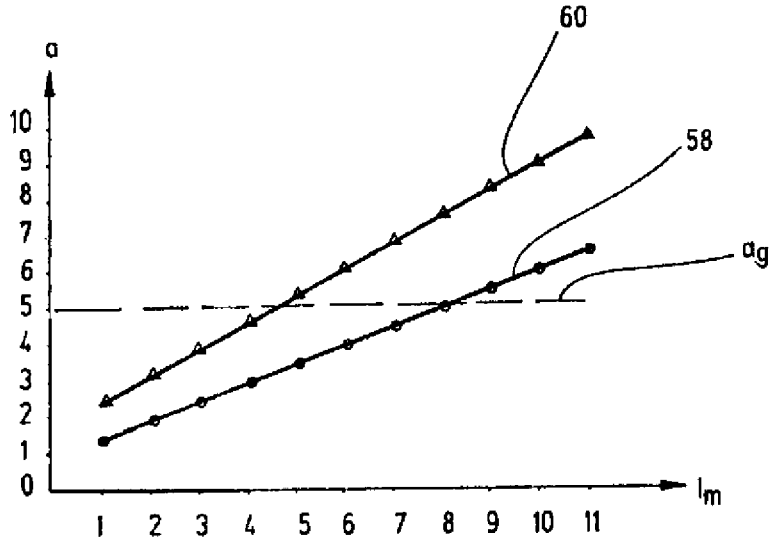
FIG. 3 shows an illustration of the standardized acceleration behaviour as a function of the distance of the centre of mass from the oscillation axis for different tools.

This relationship is illustrated by way of example in FIG. 3 for two different tools. FIG. 3 shows the standardized acceleration a over the distance $I_m$ of the centre of mass $m_s$ from the oscillation axis for two different types of tool. The associated curves are denoted by 58 and 60. For example, the curve 58 can represent different grinding tools, whilst the curve 60 could represent a sawing tool having different lengths for example, whereby different distances $I_m$ from the oscillation axis 22 are given. A maximum permissible acceleration value is indicated by the parallel $a_g$ to the abscissa.

The hand-held power tool according to the invention can automatically recognize the oscillatory behaviour of the different tools and influence the operating parameters of the hand-held power tool in such a way that the maximum permissible acceleration threshold values of 5 $m/s^2$ for example are observed.

To this end, the hand-held power tool 10 comprises at least one acceleration sensor 30 which can be placed in the region of the oscillation transmission 16 for example, as indicated by the numeral 30. In addition or alternatively, further sensors 32, 34 can be placed at other positions of the hand-held power tool 10, for example in the region of the motor 14, as shown in the case of the sensor 34, and in the transition region between the motor 14 and the oscillation transmission 16, as shown by numeral 32. For example, the sensors 30, 32, 34 can be acceleration sensors which record accelerations in one, two or three spatial directions (1D, 2D, 3D). For example, these may be piezo sensors. One or more of the sensors optionally can also be configured as a rotational acceleration sensor.

In addition, one or more of the sensors can be provided to monitor operating parameters of the hand-held power tool 10, for example to monitor the angle of rotation α or the speed n of the motor 14, or to monitor the motor current I.

In addition, a further sensor 35 can be provided so as to enable automatic recognition of which tool 26 is fastened on the tool spindle 20. For example, this sensor 35 can cooperate with an RFID chip 39 on the tool 26. Data transfer to the hand-held power tool 10 is thus enabled, for example so as to transfer the vibratory behaviour characteristic for the tool and to take into account this behaviour during control of the hand-held power tool 10.

Alternatively, tool recognition could be enabled for example via the vibratory behaviour of the fitted tool 26 in the idling state, as will be explained in greater detail hereinafter.

A motor switch 15 for switching the motor 14 on and off can also be seen in FIG. 1 at the upper end of the housing as well as a switch 31 for activating a "set-up mode" and a switch 33 which can be used to activate an "overrule mode", as will be explained in greater detail hereinafter.

A controller 36 in the form of a microprocessor controller with a memory 38 is also indicated in FIG. 1.

Figure 2:
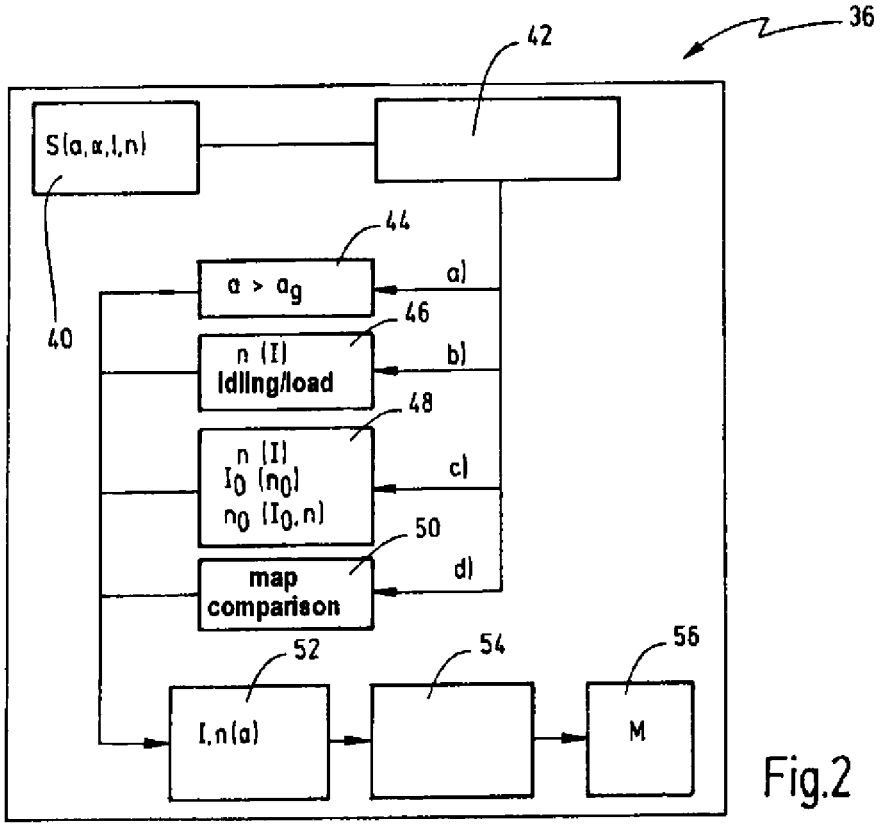
FIG. 2 shows a highly simplified block diagram of the controller of the hand-held tool.

A schematic block diagram of the controller 36 is illustrated in FIG. 2.

Different sensors S, which may be sensors for acceleration a, angle of rotation α, motor current I or speed n, are indicated by the numeral 40. The sensors S are coupled to a sensor evaluation circuit 42.

The arrangement can be provided in such a way that, according to possibility a), the controller 36 observes that an additional maximum acceleration is not exceeded, as is illustrated by numeral 44 ($a>a_g$). For example, a maximum value of 5 $m/s^2$ could be observed. To this end, the motor speed n(I) could be used as a control parameter according to motor current in the idling state ($I_0(n_0)$) or according to idling speed $n_0(I_0, U)$ and the idling voltage, as shown by numeral 48, case c). During operation, the operating parameters can optionally be adapted continuously where necessary so as to take into account the influence of the contact between the workpiece and the vibratory load, as illustrated by numeral 46, case d).

Furthermore, the operating parameters can be adapted by comparing the maps for the different operating parameters, in such a way that the permissible maximum acceleration is always observed and, at the same time, the hand-held power tool is operated in an optimal range so as to achieve the best possible working results, see numeral 50, case d).

In the next step 52, the respective control variable, that is to say normally the speed n or the motor current I, is controlled, as indicated by numeral 52, and the motor M is then controlled by a driver circuit 54, as indicated by numeral 56.

For example, the controller 36 can be programmed in such a way that, with the aid of the acceleration sensors 30, 32, 34, the respective acceleration values which are provided for example during start-up or in the idling state are recorded for the different possible tools 26 which can be received on the hand-held power tool 10. These different characteristic acceleration values can be logged and stored in the memory 38.

Once these characteristic acceleration values have been detected and stored in the set-up mode, the controller 36 automatically recognizes, during start-up and in the idling state of the hand-held power tool 10, which tool 26 is currently being operated on the hand-held power tool 10. Alternatively, the special sensor 35 could also be used to this end for tool recognition.

The controller 36 can then be programmed in such a way that, during operation, the vibrations are limited to a permissible maximum value, for which purpose the control variable is controlled correspondingly according to the signals of the acceleration sensors 30, 32, 34, as illustrated by numeral 52.

Figure 4:
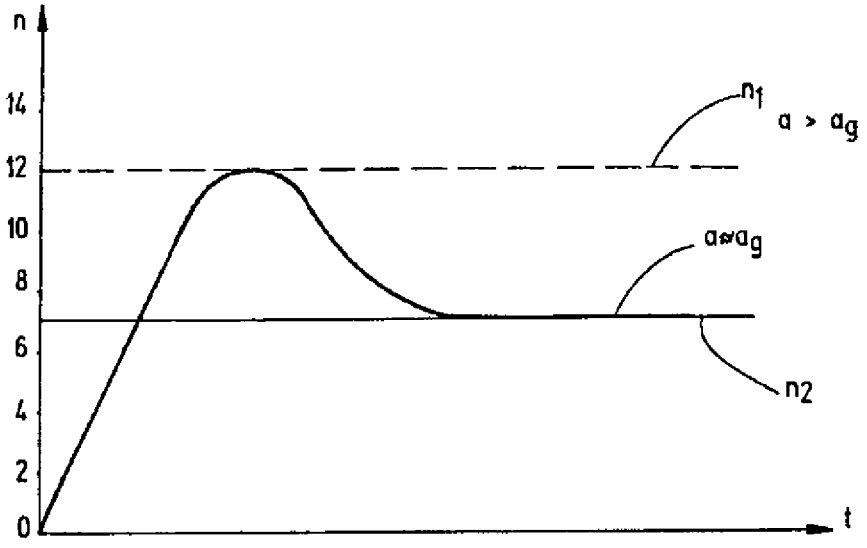
FIG. 4 shows an illustration of the standardized speed over time, which represents the temporal course of a speed limitation, as a result of which the vibratory behaviour of the hand-held power tool is limited to a permissible acceleration value.

Control behaviour of this type is illustrated by way of example in FIG. 4.

FIG. 4 shows a standardized illustration of the speed n over time. Whilst the speed n initially increases to a value $n_1$, which lies above the permissible threshold value $a_g$, the speed n is automatically limited by the controller 36 to a value $n_2$, at which the acceleration a corresponds approximately to the maximum permissible acceleration $a_g$, that is to say for example 5 $m/s^2$, so that work is carried out at the maximum permissible speed, at which the threshold value $a_g$ for the acceleration is still observed.

The set-up mode can be run for example on a sample machine (master) with the different possible tools, and the corresponding characteristic acceleration values can be logged. These characteristic values can be stored in the memory 38 of the controller 36.

The arrangement can be provided in such a way that, during start-up or in the idling state of the hand-held power tool, the controller 36 automatically recognizes which tool 26 has been received due to the stored characteristic values.

Alternatively or in addition, the set-up mode can be initiated manually, for which purpose the switch 33 (see FIG. 1) can be provided. Alternatively, the set-up mode could be initiated for example upon each start-up of the controller 36 or upon each renewed connection of the hand-held power tool to an external power source (for example when the power cord is plugged in).

The switch 31 according to FIG. 1, which initiates the "overrule mode", can be provided to temporarily switch off the normally automatic limitation of the speed n or of the motor current I, as a result of which the vibratory behaviour is limited to a permissible maximum value, for example so as to ensure particularly effective operation for a short period of time which is so short that it is not disadvantageous for the user. This overrule mode could be deactivated again automatically, for example once a specific period of time has elapsed, so that the operating parameters are again limited so as to ensure that the vibratory behaviour of the machine is limited to the permissible maximum value. For example, the arrangement could also be provided in such a way that the overrule mode is reset again upon each new start of the machine (for example when the power cord is plugged in).

What is claimed is:

1. A hand-held power tool machine, comprising:

a motor for driving said hand-held power tool machine;

a controller for controlling said hand-held power tool machine;

at least one sensor for detecting vibrations of said hand-held power tool machine and for generating an output signal characteristic for said vibrations;

wherein said hand-held power tool machine is configured for operating with a plurality of different tools;

wherein said controller is coupled to said at least one sensor and said motor and is configured for evaluating said output signal to generate at least one control signal fed to said motor for controlling at least one operating parameter of said motor depending on said evaluation of said output signal of said at least one sensor for limiting vibrations of said power tool machine to a permissible maximum value based on said particular tool and on said output signal of said sensor.

2. A method of controlling a hand-held power tool machine, comprising the steps of:

detecting at least one characteristic value for vibrations;

storing said at least one characteristic value for each one of a plurality of different tools with which the hand-held power tool machine can be operated;

comparing said stored characteristic value with a characteristic value for vibrations with a tool currently received on the hand-held power tool machine and generating a control signal thereby; and controlling at least one operating parameter of a motor driving said hand-held power tool machine using said control signal to effect a limitation of vibrations of said power tool to a permissible maximum value.

3. A hand-held power tool machine, comprising:

a motor;

an oscillation drive driven by said motor for driving a tool in an oscillating manner;

a controller for controlling said hand-held power tool machine;

at least one sensor for detecting vibrations of said hand-held power tool machine and for generating an output signal characteristic for said vibrations; and a storage coupled to said controller;

wherein said hand-held power tool machine is configured for operating with a plurality of different tools;

wherein said storage is configured for storing characteristic values for vibrations caused by particular tools of said plurality of different tools;

wherein said controller is coupled to said at least one sensor and said motor and is configured for comparing said output signal of said at least one sensor with said stored characteristic values for vibrations for detecting said particular tool;

and wherein said controller is further configured for generating a control signal fed to said motor for controlling at least one operating parameter of said motor according to said comparison for limiting vibrations to a permissible maximum value based on said characteristic values for vibrations of said particular tool and on said output signal of said sensor.

4. The hand-held power tool machine of claim 3, wherein said controller is configured for evaluating said output signal of said at least one sensor during a state selected from the group consisting of an idling mode and a start-up mode.

5. The hand-held power tool machine of claim 4, wherein said start-up mode is run at least during a first start-up of said hand-held power tool machine.

6. The hand-held power tool machine of claim 4, wherein said controller is configured for automatically activating said start-up mode depending on a particular condition.

7. The hand-held power tool machine of claim 4, wherein said controller is configured for automatically activating said start-up mode depending on a condition selected form the group consisting of each new start of the controller and each new connection of the hand-held power tool machine to an external power supply.

8. The hand-held power tool machine of claim 3, wherein said controller is configured for recording and storing said output signal of said at least one sensor for each tool selected from said plurality of different tools.

9. The hand-held power tool machine of claim 8, wherein said controller is configured for recording and storing said output signal of said at least one sensor for each tool selected from said plurality of different tools during a state selected from the group formed by an idling mode and a start-up mode of said hand-held power tool machine.

10. The hand-held power tool machine of claim 9, wherein said controller is configured for evaluating said output signal of said at least one sensor and for comparing it with said stored values for said plurality of different tools so as to determine the type of tool.

11. The hand-held power tool machine of claim 10, wherein said controller is configured for optimizing the operating parameters according to the type of tool determined.

12. The hand-held power tool machine of claim 3, further comprising a sensor for tool recognition.

13. The hand-held power tool machine of claim 3, further comprising a device for transferring data from the tool to the hand-held power tool machine.

14. The hand-held power tool machine of claim 3, wherein said controller is configured for storing a map of operating parameters of each of said plurality of different tools.

15. The hand-held power tool machine of claim 3, wherein said controller is configured for limiting speed or power consumption so as to avoid that a maximum value for acceleration of the hand-held power tool machine in at least one direction is exceeded.

16. The hand-held power tool machine of claim 15, wherein said controller is configured for limiting acceleration in at least one spatial direction to a maximum value of 5 $m/s^2$.

17. The hand-held power tool machine of claim 3, wherein at least one sensor is provided which is selected from the group consisting of an acceleration sensor in one, two or three directions, a rotational acceleration sensor, an amperage sensor, a speed sensor, a voltage sensor and a phase sensor for controlling phase angle of a power supply.

18. The hand-held power tool machine of claim 3, further comprising:

a storage for storing characteristic values for vibrations caused by particular tools of said plurality of different tools;

wherein said controller is configured for comparing said output signal of said at least one sensor with said stored characteristic values for vibrations and for generating said control signal for controlling said at least one operating parameter of said motor according to said comparison.

* * * * *